United States Patent [19]

Kaminski et al.

[11] Patent Number: 4,686,913

[45] Date of Patent: Aug. 18, 1987

[54] REFUSE DERIVED FUEL DELIVERY SYSTEM AND DISTRIBUTION CONVEYORS

[76] Inventors: Donald J. Kaminski, 122 E. White Oak Way, Mequon, Wis. 53092; Ernest A. Frank, N75 W34140 Brice Rd., Oconomowoc, Wis. 53066; Craig S. Grinsteiner, 2049 S. 76th St., West Allis, Wis. 53219

[21] Appl. No.: 946,676

[22] Filed: Jan. 5, 1987

Related U.S. Application Data

[63] Continuation of Ser. No. 859,861, May 1, 1986, abandoned, which is a continuation of Ser. No. 704,502, Feb. 22, 1985, abandoned.

[51] Int. Cl.[4] ..... F23K 3/00

[52] U.S. Cl. ..... 110/110; 110/117; 110/286; 110/292; 110/293; 414/173

[58] Field of Search ..... 110/267, 286, 292, 293, 110/327, 101 B, 104 R, 108, 109, 110, 117, 118; 414/160, 173; 222/109, 318, 415

[56] References Cited

U.S. PATENT DOCUMENTS

| | | | |
|---|---|---|---|
| 1,491,101 | 4/1924 | Himmelsbach | 110/101 R |
| 1,658,049 | 2/1928 | Howse | 110/109 |
| 2,702,643 | 2/1955 | Fisher | 414/173 X |
| 2,893,601 | 7/1959 | Barber et al. | 222/318 |
| 3,942,455 | 3/1976 | Wallis | 110/110 X |
| 4,257,334 | 3/1981 | Mueller | 110/104 B |
| 4,315,468 | 2/1982 | Tyer et al. | 110/267 X |
| 4,416,547 | 11/1983 | Mikolajczyk | 222/415 X |

*Primary Examiner*—Albert J. Makay
*Assistant Examiner*—Steven E. Warner
*Attorney, Agent, or Firm*—Michael, Best and Friedrich

[57] ABSTRACT

Apparatus for feeding solid waste material to one or more chargers of the type for forcing solid waste material into a furnace or boiler. An elongated auger housing is mounted above the chargers and includes a plurality of openings along its length and for depositing solid waste material into hoppers of the chargers. An auger is supported in the housing and conveys solid waste from one end of the auger housing to the other. A supply conveyor is provided for carrying a continuous supply of solid waste material to one end of the auger housing from a supply container. A return conveyor is positioned adjacent a discharge end of the auger housing and returns excess waste material to the supply container.

21 Claims, 6 Drawing Figures

REFUSE DERIVED FUEL DELIVERY SYSTEM AND DISTRIBUTION CONVEYORS

This is a continuation of co-pending application Ser. No. 859,861, which filed on May 1, 1986 is a continuation of application Ser. No. 704,502, filed on Feb. 22, 1985, both now abandoned.

FIELD OF THE INVENTION

The present invention is directed to apparatus for use in supplying waste material or other similar types of solid fuel to furnaces or boilers.

BACKGROUND PRIOR ART

One of the common problems in connection with the use of solid waste materials such as municipal refuse for use in producing heat or electricity is providing a uniform supply of the appropriate amount of fuel to the furnace. Municipal waste contains a variety of different types of combustible materials including paper, plastic, leather and fabric. In common prior art systems these materials are fed to shredding apparatus and comminuted to form small pieces of material which can then be fed to the furnace by a conveying means. It is also common that the waste material is not thoroughly shredded and may include lengths of fabric, rope, twine or wire.

In one conventional apparatus for use in feeding refuse material to a furnace, comminuted or shredded refuse material is housed in a large bin and a plurality of augers are housed in the bottom of the bin. The augers feed refuse material to a plurality of fuel charging devices, and the fuel charging devices in turn feed the waste material to the furnace. During the operation of these machines, wire, rope twine or other lengths of material may become wound around the augers at the bottom of the large bin placing a heavy load on the auger drive system or stopping the augers entirely. Waste material can also become jammed in the auger flights or between the auger flights and the auger housing. It is common that the waste material may be 15 or 20 feed deep in the bin, and servicing of the augers requires removal of the material above the augers.

Another problem encountered with augers for use in feeding waste material to a furnace is that hard materials may become jammed between the peripheral edges of the auger flights and the inside surface of the auger trough or housing thereby causing the auger to stop. In many common auger arrangements, the periphery of the auger is closely spaced with respect to the inner surface of an auger trough. Pieces of metal, stones or cinders in the refuse can be wedged between the auger flight and the housing, thereby stopping the auger.

One of the requirements of a fuel delivery system for commercially successful boilers is that fuel may be delivered at a uniform rate for extended periods of time. Interruptions in the delivery of fuel to the boiler are undesireable, and auger constructions are not commercially functional if the auger can be stopped by accumulations of materials or lengths of materials becoming wound around the auger or as a result of hard materials becoming jammed between the auger flight and the auger trough.

SUMMARY OF THE INVENTION

The present invention is directed to an improved apparatus for feeding comminuted combustible solid waste material to a furnace such that that material can be burned in a continuous and uniform manner and so that the furnace is supplied with a constant source of fuel.

The apparatus embodying the invention can be used with a furnace having one or more conventional chargers adapted to receive comminuted combustible solid waste material and includes a means for providing a continuous supply of such waste material to the chargers. The means for supplying waste material comprises at least one auger housing mounted above the one or more chargers, and the auger housing includes a plurality of openings in its bottom spaced apart along the length of the auger housing with one opening being positioned above each of the chargers. Solid waste material is deposited through the openings in the bottom of the housing into the chargers. An auger is housed in the auger housing and provides a means for moving the solid waste material along the length of the auger housing so that the waste material will be deposited through each of the openings.

Conveyor means are also provided for carrying a continuous supply of solid waste material to the auger housing. A second conveyor means is provided for receiving solid waste material from a discharge end of the auger and for returning the solid waste material to a waste material supply area. In a preferred form of the invention the conveyor means for supplying waste material to the auger will supply enough solid waste to the chargers that excess solid waste material will be delivered to the second conveyor means. Any solid waste material moved along the length of the auger housing and not deposited through the openings into the chargers will be conveyed along the full length of the auger housing and will be returned to the solid waste supply conveyor.

One of the advantages of the present invention is that the apparatus for supplying solid waste to the chargers facilitates the provision of redundant components for carrying the solid waste materials to the chargers. Each operation can be accomplished by side-by-side apparatus. If one machine or component of the apparatus is stopped because of failure or for repair, the redundant apparatus can continue to operate. Additionally, repair or maintenance of this apparatus can be accomplished while the secondary or redundant unit operates, and it is not necessary to shut down the entire system.

The auger system is also designed such that the augers are not located beneath large quantities of refuse. The augers of the apparatus embodying the invention are readily accessible and can be repaired without interrupting operation of the boiler. While the augers are constructed such that they are not readily jammed or otherwise rendered inoperable by the solid waste being conveyed to the chargers, in the event that one of the augers ceases to operate, the adjacent redundant auger can continue to supply solid waste material to the chargers while the other auger is repaired.

One of the advantages of the present invention is that the augers are not covered by large quantities of solid waste material and maintenance of the augers is accomplished without removal of a substantial quantity of the solid waste material from the auger housing.

One of the principal features of the distribution augers included in the apparatus embodying the invention is that the central auger tube has a diameter of at least 18 inches and the auger will have a diameter of approximately 4 feet or greater.

Another of the principal features of the invention is that the auger flights will be spaced such that there will be a space of at least approximately 2 inches between the periphery of the auger flight and the bottom surface of the auger trough.

Various other features and advantages of the invention will be apparent by reference to the following description of a preferred embodiment, from the drawings and from the claims.

Figure 1:
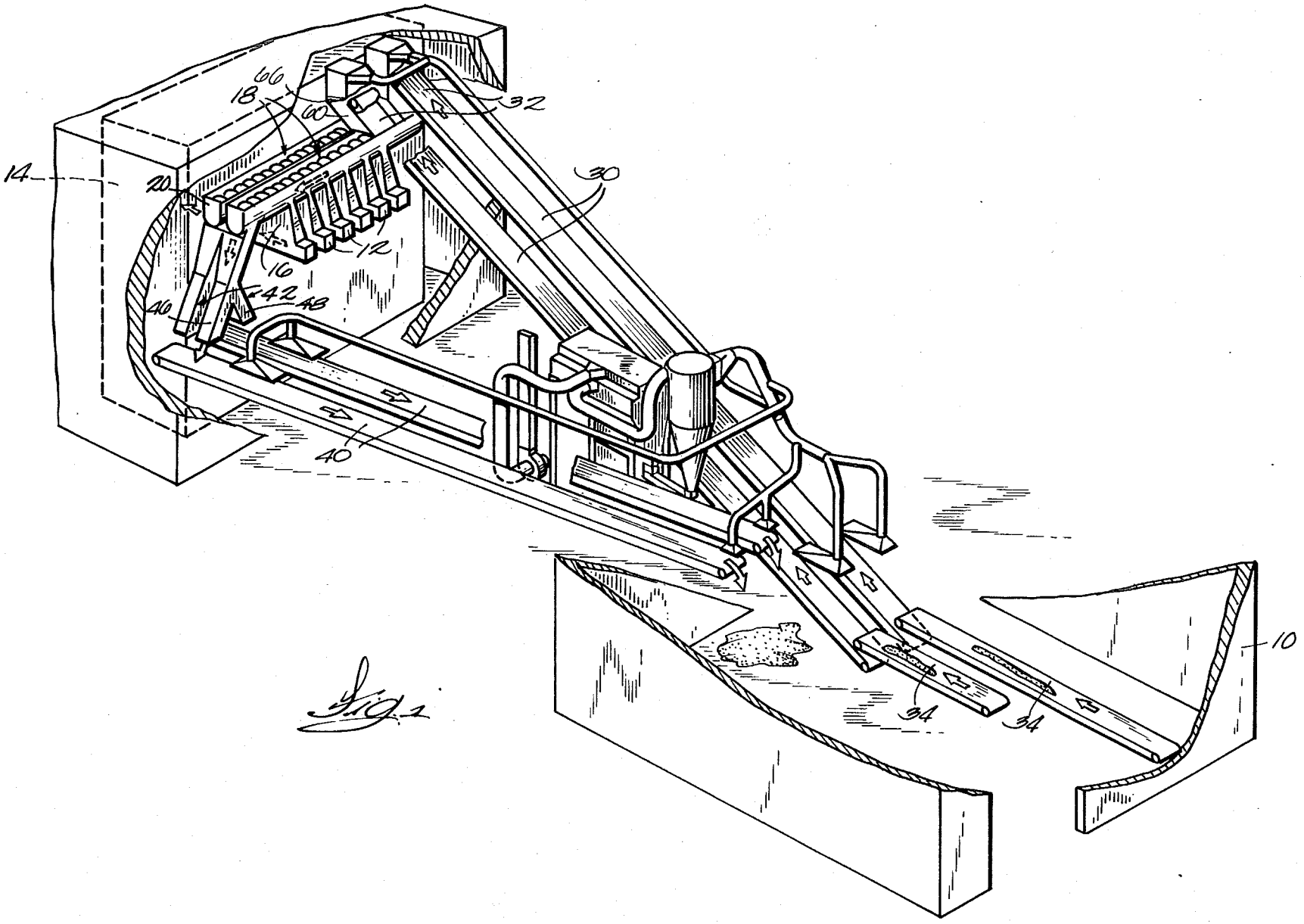
FIG. 1 is a perspective view of a solid waste refuse handling system embodying the invention.

Before describing a preferred embodiment of the invention, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a system embodying the present invention and for use in supplying comminuted combustible solid waste material from a refuse material supply container 10 to a plurality of chargers 12 of the type for conveying solid waste material into a boiler 14 continuously and in controlled amounts. While the solid waste material could be stored in various ways, in the illustrated arrangement the solid waste material container 10 comprises a building. The charges 12 for use in supplying the refuse fuel material to the boiler 14 do not form subject matter of the invention and have a conventional construction. While various numbers of chargers 12 can be employed depending on the fuel requirements of the boiler 14 and the capability of the chargers 12, for purposes of example, six chargers 12 are shown in side-by-side aligned relation. Each of the chargers includes a bin or hopper 16 for receiving waste material, each bin 16 being open at the top. As is conventional, the chargers 12 are intended to operate with the bins or hoppers 16 filled with refuse fuel material. The material in the bottom of the bins 16 being conveyed in a controlled manner into the furnace or boiler 14.

Means are also provided for supplying refuse derived fuel material to the bins 16, this means including at least one distribution auger assembly 18 positioned above the bins 16 and extending across each of the side-by-side bins. In the particular embodiment of the invention illustrated in the drawings, a pair of side-by-side distribution auger assemblies 18 are provided, one of the distribution auger assemblies 18 functioning as a primary auger assembly and the other of the auger assemblies providing a redundant or back-up means for providing a continuous supply of material to the boiler feed bins 16 in the event there is a failure of one of the augers or during maintenance of one of the auger assemblies. Each distribution auger assembly 18 includes an auger housing 20 defining a trough 22 (FIG. 4) having a bottom 24 forming a semi-cylindrical chamber. The distribution auger assemblies 18 also each include a helical auger 26 mounted in the elongated auger housing 20 adjacent the bottom wall and extending along the length of the auger housing. Each auger housing bottom 24 includes a plurality of openings 28 spaced apart along its length, and the openings 28 are located above the bins 16 of respective ones the boiler feed chargers 12 and such that comminuted solid waste material moved along the length of the auger housing 20 by the auger 26 and can fall through the openings 28 into the bins 16 to fill the bins.

Means are also provided for feeding refuse material from the refuse material supply container 10 to a material receiving end 36 of the auger assemblies 18. In the illustrated construction this means includes a pair of elongated belt conveyors 30, the belt conveyors 30 each including one end housed in the refuse supply container 10. The elongated belt conveyors 30 are inclined upwardly and each include an upper end 32 positioned above supply ends of the distribution auger assemblies 18. While in other constructions of the invention, a single inclined feed conveyor 30 could be employed, in the illustrated arrangement a pair of side-by-side conveyors are employed. One of the conveyors comprises a primary inclined feed conveyor while the other comprises a back-up conveyor to be employed if the primary conveyor fails or during maintenance of the primary conveyor.

In the illustrated construction the means for feeding refuse material also includes a pair of horizontal feed conveyors 34 for use in supplying solid waste material to the lower ends of the inclined feed conveyors 30. Front end loaders of other suitable equipment can be used to supply waste material to the horizontal feed conveyors 34.

Means are also provided at the upper or discharge ends 32 of the inclined feed conveyors 30 for delivering the waste material into the ends of the auger housings 20. In a preferred form of the invention, and as illustrated in the drawings, the means for delivering the waste material into the upstream end of the auger housings includes a means for alternatively depositing the solid waste material into one auger housing 20 or the other.

Figure 4:
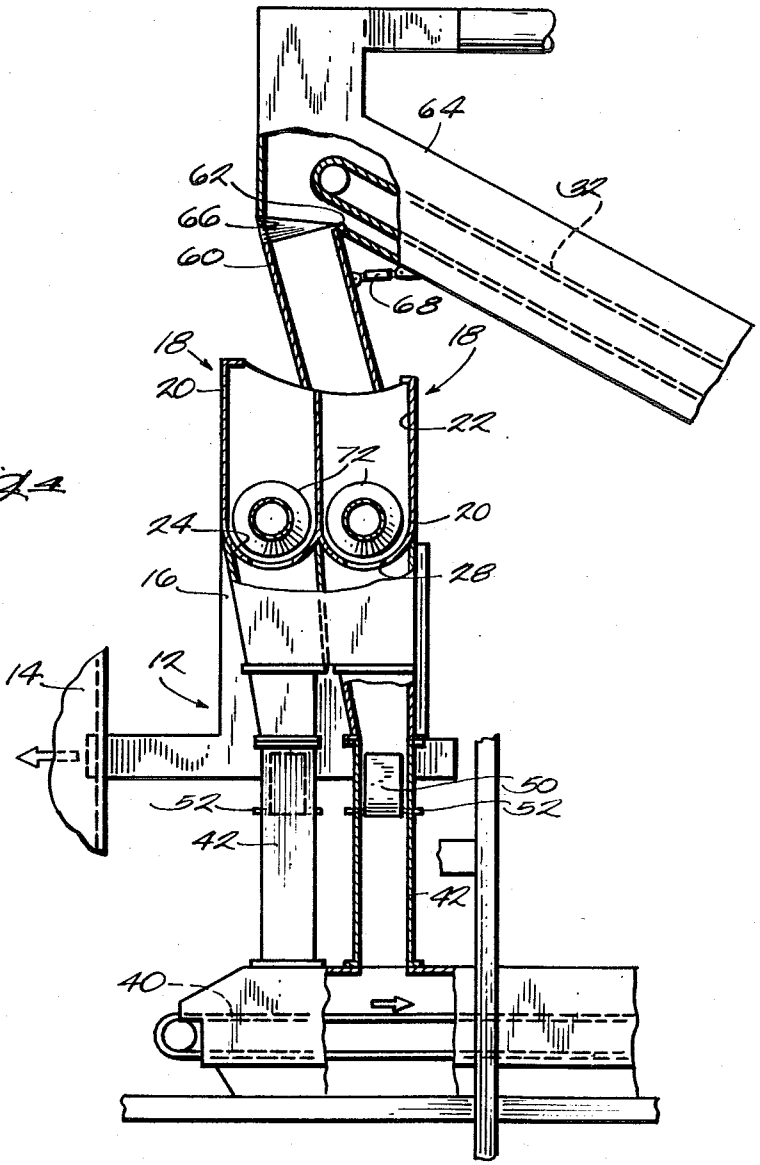
FIG. 4 is an end elevation view of apparatus illustrated in FIGS. 2 and 3.

While various means could be provided, in the illustrated construction this means includes a pair of feed or waste material supply chutes 60. The supply chutes 60 each include an upper portion positioned beneath the discharge end of the respective one of the supply conveyors 30 and a lower end positioned above the material receiving end 36 of one of the auger assemblies 18. In the illustrated arrrangement means are also provided for permitting each supply chute 60 to be shifted between a first position wherein the lower or discharge end of the supply chute 60 is positioned above one of the augers 26 to a second position wherein a discharge end of the supply chute 60 is positioned above the other auger 26. As illustrated in FIG. 4, the upper end of each supply chute is pivotally joined by a pin 62 to the lower portion of a housing 64 surrounding the feed conveyor. A flexible chute portion 66 extends between a discharge opening in the bottom of an upper end of the housing 64 and the upper end of the chute 60 to connect the housing 64 to the supply chute 60. The flexible chute portion provides for swingable movement of the supply chute 60 with respect to the housing 64.

Means are also provided for causing swingable movement of the supply chute 60 between the position shown in FIG. 4 to a position wherein the supply chute 60 can deliver refuse material to the other auger assembly 18. While this means could have various constructions, in the illustrated arrangement it includes a hydraulic cylinder 68 having one end pivotally joined to the housing 64 surrounding the feed conveyor 30 and an opposite end connected to the swingable supply chute 60.

Means are also provided at the discharge ends 38 of the auger assemblies 18 for receiving excess refuse material and for returning that refuse material to the refuse material supply container 10. In operation of the auger assemblies and the conveyors supplying refuse to the augers, refuse material is conveyed along the length of a selected one of the auger housings 20 by the rotation of the augers 26 and from the material receiving end 36 to a material discharge end 40. As the refuse material moves along the length of an auger housing 20 a quantity of this material will fall into the opening 28 closest to the refuse material receiving end of the auger housing. Once the charger bin 16 beneath that opening 28 has been filled, the refuse material will be carried to the next opening 28, and the charger bin 16 beneath that opening 28 will be filled. In a preferred form of the invention, each waste material feed conveyor 30 and auger 26 will have a capacity to supply an excess of waste material to the charger bins 16 such that all of the bins 16 under the augers 26 will be kept full. The excess material in the auger housing 20 will be carried by auger 26 to the discharge end 38 of the auger housing and will be deposited onto means for receiving the excess refuse material.

In a preferred form of the invention, the means for receiving the excess refuse material and for conveying it to the refuse material supply container 10 comprises a pair of return conveyors 40 comprised of conveyor belts each having one end positioned beneath the discharge ends 38 of the auger housings 20 and an opposite end in the solid waste material container.

Means are also provided at the discharge end 38 of each auger housing 20 for depositing the excess waste material onto the return conveyors 40. In the illustrated construction, this means comprises discharge chutes 42. Each of the discharge chutes 42 includes an upper end 44 integrally joined to the bottom of the discharge end 38 of an auger housing 20. The lower end of the discharge chute 42 includes a first chute portion 46 positioned over an end of one of the return conveyors 40 and a second chute portion 48 diverging from the first chute portion 46 and having a lower end positioned above the other of the return conveyors 40.

Figure 2:
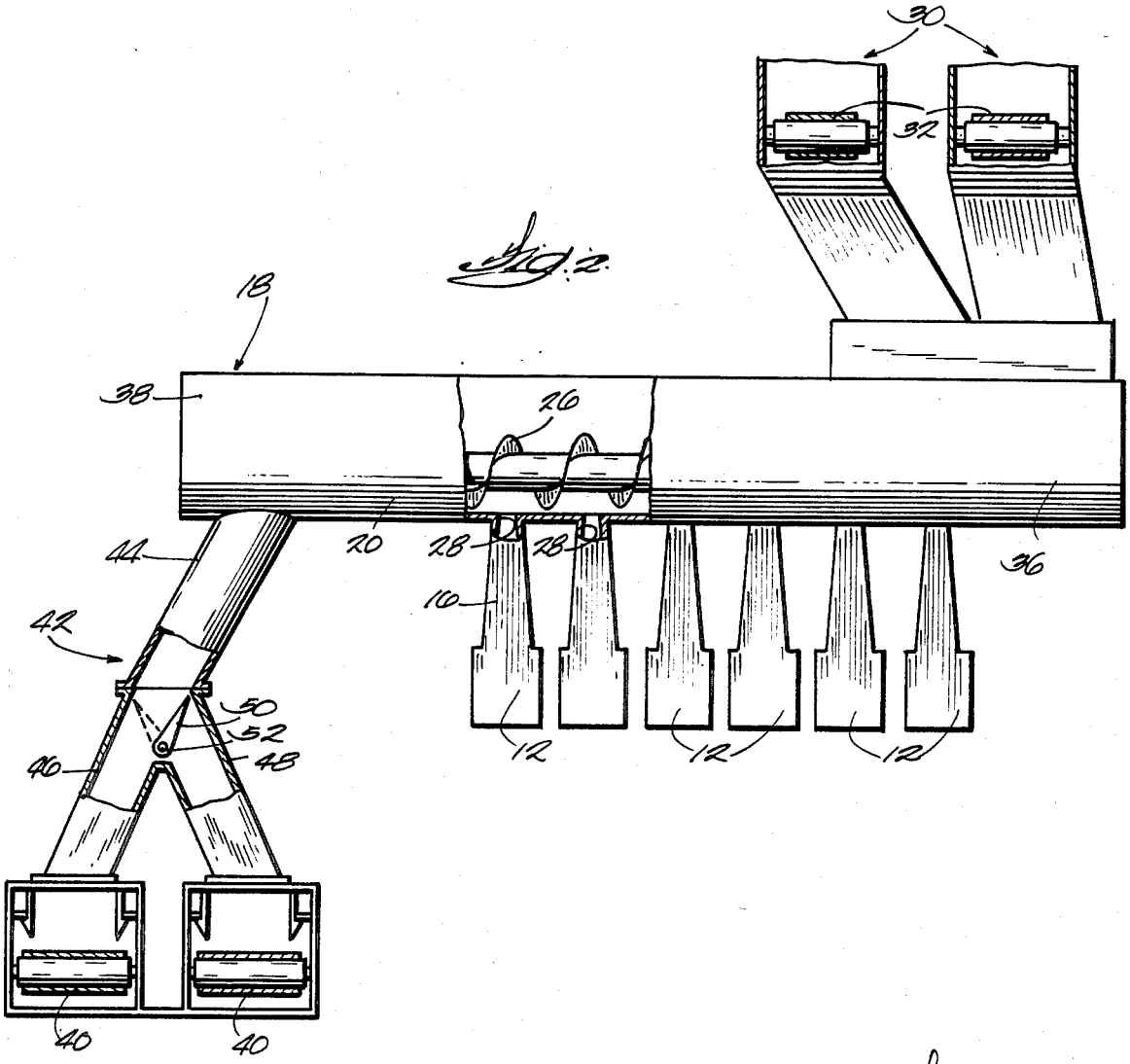
FIG. 2 is an elevation view of a portion of the refuse handling system shown in FIG. 1 and with portions broken away in the interest of clarity.
Figure 3:
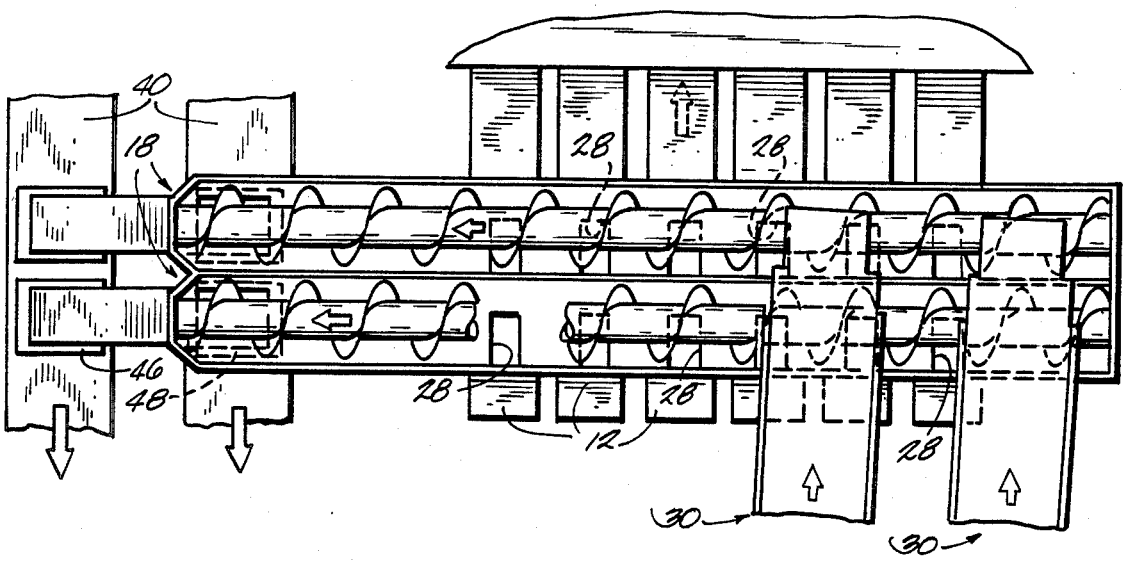
FIG. 3 is a cross-section plan view of apparatus illustrated in FIG. 2.
Figure 5:
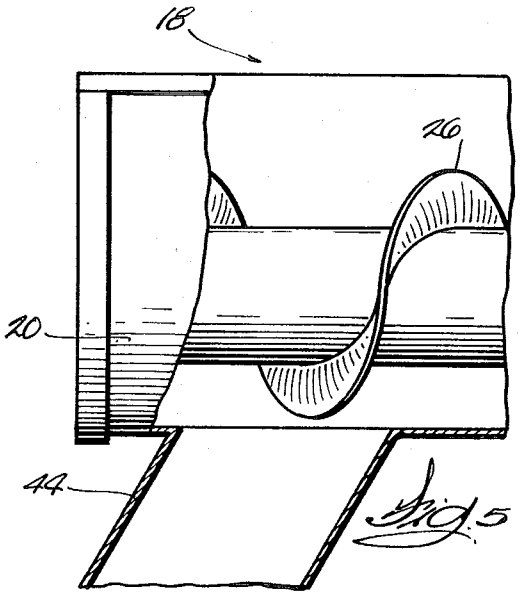
FIG. 5 is an enlarged partial view of apparatus illustrated in FIG. 2 and with portions broken away.
Figure 6:
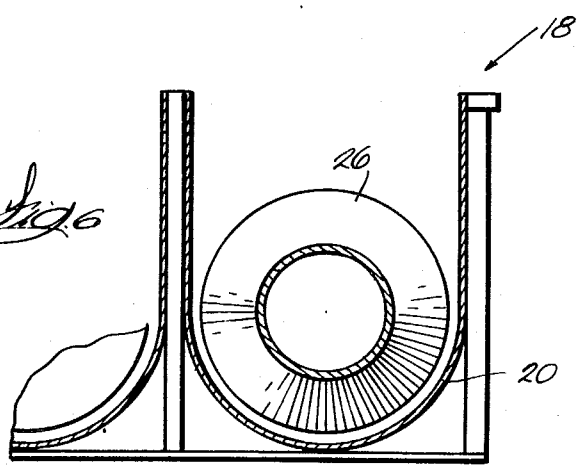
FIG. 6 is an end view of the apparatus illustrated in FIG. 5.

Means are also provided for causing the refuse material to be discharged selectively through either the first chute portion 46 or the second chute portion 48 onto the return conveyors 40. In the illustrated construction this means comprises a diverter plate 50 mounted in the discharge chute 42 and supported for selective pivotable movement by a shaft 52 between the position shown in solid lines in FIG. 2 and the position shown in phantom. The diverter plate 50 functions to cause the solid waste material to be deposited on one of the discharge conveyors 40 or the other.

Referring more specifically to the construction of the augers 26 and the auger housings 20, in a preferred form of the invention, each auger includes a central relatively large diameter cylindrical tube 70 supported at its opposite ends by bearings (not shown) in turn supported by the opposite ends of the auger housings 20. Each of the auger tubes is surrounded by helical auger flights 72. In one preferred form of the invention each auger 26 will have a diameter of approximately four feet and the central tube of each auger 26 will have a diameter of approximately at least 18 inches. In one preferred form of the invention the central auger tube 70 will have a diameter of two feet. It has been found that an auger of such size, being substantially larger than conventional augers used convey solid waste material to charging apparatus of a boiler, are less likely to become clogged or jammed. Additionally, in the preferred form of the invention, the periphery of the auger flight 72 and the inside surface of the bottom of the auger housing 20 will define a gap of approximately two inches. It has been found that this gap between the periphery of the auger 26 and the auger housing 20 prevents jamming of solid materials between the periphery of the auger 26 and the interior surface of the auger housing 20. If the space between the periphery of the auger and the auger housing is substantially less than two inches, hard solid materials can become wedged between the auger flights 72 and the auger housing 20 and therby either place excessive loads on the auger drive mechanism or stop the augers entirety.

While in the illustrated construction the augers 26 deposit refuse material into chargers 12 for conveyance to the boiler, in other arrangements, other apparatus could receive the refuse material from the openings in the auger housings and supply that material to the boiler.

Various features of the invention are set forth in the following claims:

1. Apparatus for supplying comminuted combustible solid waste material from a refuse material supply to a combustion apparatus for use as fuel and wherein the combustin apparatus includes at least two fuel charging means each having a hopper for receiving comminuted combustible solid waste material, and the hoppers being positioed in side-by-side relation, the apparatus comprising:

an auger housing mounted above the hoppers of the fuel charging means, the auger housing including an inner surface and a bottom having at least two openings, one of the openings positioned above one of the hoppers and the other opening positioned above the other of the hoppers whereby solid material can fall from the auger housing through the openings into the hoppers, an auger mounted in said auger housing and supported therein for rotation around a central longitudinal axis so as to carry refuse material from one end of said auger housing toward an opposite end of said auger housing, said auger including a central auger tube and an auger flight surrounding said auger tube and fixed to said auger tube, said auger tube having a diameter of at least approximately 18 inches, said auger having a diameter of at least approximately 4 feet, and said auger including a periphery spaced from said inner surface of said auger housing by at least approximately 2 inches, means for conveying solid waste material from the refuse material supply to said one end of said auger housing and including means for depositing refuse into said one end of said auger housing, and a return conveyor mounted adjacent said opposite end of said auger housing and adapted to receive material from said opposite end of said auger housing.

2. Apparatus as set forth in claim 1 wherein said means for conveying solid waste material includes a supply conveyor, said supply conveyor including opposite ends, one of said opposite ends being adjacent said refuse material supply and an opposite end being positioned above said one end of said auger housing, and wherein said return conveyor includes opposite ends, one of said return conveyor opposite ends being positioned beneath the other of said opposite ends of said auger housing and adapted to receive solid waste material from said auger housing, and the other of said return conveyor opposite ends returning refuse material to the refuse material supply.

3. Apparatus as set forth in claim 1 wherein the combustion apparatus includes a plurality of fuel charging means positioned in side-by-side relation, each of said fuel charging means including a hopper for containing solid waste material, and wherein said auger housing includes a plurality of discharge openings spaced apart along the length of said auger housings, said openings being positioned above respective ones of the hoppers for depositing solid waste material into the hoppers.

4. Apparatus as set forth in claim 3 and further including a second auger housing mounted above said hoppers, said second auger housing being parallel to said first auger housing, and said second auger housing including a plurality of discharge openings spaced apart along the length of said second auger housing, said openings being positioned above respective ones of said hoppers and for depositing solid waste material into said hoppers.

5. Apparatus as set forth in claim 4 wherein said means for conveying solid waste material from the refuse material supply container includes a pair of supply conveyors positioned in side-by-side parallel relation, each of said supply conveyors including one end positioned adjacent the refuse material supply container and an opposite end positioned above said auger housings and for depositing solid waste material into said auger housings.

6. Apparatus as set forth in claim 5 and further including a second return conveyor positioned adjacent and in side-by-side relation to said return conveyor, and wherein said return conveyors each include opposite ends, one of said opposite ends of each of said return conveyors being positioned beneath discharge ends of said auger housings for receiving material from said auger housings and opposite ends adjacent said refuse material supply for returning refuse materials to said refuse material supply.

7. Apparatus for supplying solid waste material from a refuse material supply to a combustion apparatus for use as fuel in the combustion apparatus, the apparatus comprising:

a plurality of chargers for supplying solid waste material to the combustion apparatus, said chargers being positioned in side-by-side relation, each of said chargers including a solid waste material container housing a quantity of solid waste material, said solid waste material containers each including an opening, an auger housing mounted above said chargers, said auger housing including an inner surface and opposite ends and a bottom having a plurality of openings communicating with said solid waste material containers of said chargers whereby said material can fall through said openings into said solid waste material containers, an auger mounted in said auger housing and supported therein for rotation around a central longitudinal axis so as to carry refuse material from one end of said auger housing toward an opposite end of said auger housing, said auger including a central auger tube and an auger flight surrounding said auger tube and fixed to said auger tube, said auger having a diameter of at least approximately 4 feet, said auger tube having a diameter of at least approximately 18 inches, and said auger including a periphery spaced from said inner surface of said auger housing by at least approximately 2 inches, means for conveying solid waste material from the refuse material supply to said one end of said auger housing and including means for depositing refuse into said one end of said auger housing, and a return conveyer mounted adjacent said opposite end of said auger housing and adapted to receive material from said opposite end of said auger housing.

8. Apparatus as set forth in claim 7 wherein said means for conveying solid waste material includes a supply conveyor, said supply conveyor including opposite ends, one of said opposite ends being adjacent said refuse material supply and an opposite end being positioned above said one end of said auger housing and wherein said return conveyor includes opposite ends, one of said return conveyor opposite ends being positioned beneath the other of said opposite ends of said auger housing and adapted to receive solid waste material from said auger housing, and the other of said return conveyor opposite ends returning refuse material to the refuse material supply.

9. Apparatus as set forth in claim 7 and further including a second auger housing mounted above said solid waste material supply containers, said second auger housing being parallel to said first auger housing, and said second auger housing including a plurality of discharge openings spaced apart along the length of said second auger housing, said openings being positioned above respective ones of said solid waste material supply containers and for depositing solid waste material into said solid waste material supply containers.

10. Apparatus as set forth in claim 9 wherein said means for conveying solid waste material from the refuse material supply includes a pair of supply conveyors positioned in side-by-side parallel relation, each of said supply conveyors including one end positioned adjacent the refuse material supply container and an opposite end positioned above said auger housings and for depositing solid waste material into said auger housings.

11. Apparatus as set forth in claim and further including a second return conveyor positioned adjacent and in side-by-side relation to said return conveyor, and wherein said return conveyors each include opposite ends, one of said opposite ends of each of said return conveyors being positioned beneath discharge ends of said auger housings for receiving material from said auger housings and opposite ends adjacent said refuse material supply for returning refuse material to said refuse material supply.

12. An auger assembly for use with apparatus for supplying solid waste material to an apparatus for burning the solid waste material and wherein the apparatus for supplying solid waste material to the apparatus for burning the solid waste material includes a plurality of chargers each having a solid waste storage container, the chargers being positioned in side-by-side relation, the auger assembly comprising:

an auger housing mounted above the solid waste storage containers, the auger housing having an inner surface and including a bottom having a plurality of openings communicating with the solid waste storage containers whereby solid material can fall into the solid waste storage containers, and an auger mounted in said auger housing and supported therein for rotation around a central longitudinal axis so as to carry refuse material from one end of said auger housing toward an opposite end of said auger housing, said auger including a central auger tube and an auger flight surrounding said auger tube and fixed to said auger tube, said auger tube having a diameter of at least approximately 18 inches and said auger having a diameter of at least approximately 4 feet, and said auger including a periphery spaced from said inner surface of said anger housing by at least approximately 2 inches.

13. Apparatus for supplying solid waste material from a refuse material supply to a combustion apparatus for use as fuel and wherein the combustion apparatus includes at least one fuel charging means having a hopper for receiving comminuted combustible solid waste material, the apparatus comprising:

an auger housing having opposite ends and being mounted above the hopper of the fuel charging means, the auger housing including a bottom having an opening communicating with the hopper whereby solid material can fall from the auger housing into the hopper, an auger mounted in said auger housing and supported therein for rotation around a central longitudinal axis so as to carry refuse material from one end of said auger housing toward an opposite end of said auger housing, means for returning refuse material to said refuse material supply, said means for returning including a return conveyor mounted adjacent said opposite end of said auger housing and adapted to receive material from said opposite end of said auger housing, said combustion apparatus including a plurality of fuel charging means positioned in side-by-side relation, each of said fuel charging means including a hopper for containing solid waste material, and wherein said auger housing includes a plurality of discharge openings spaced apart along the length of said auger housings, said openings being positioned above respective ones of the hoppers for depositing solid waste material into the hoppers, a second auger housing mounted above said hoppers, said second auger housing including opposite ends, one of said ends being adapted to receive solid waste material from the means for conveying solid waste and the other of said ends being adapted to deliver said waste to said means for returning refuse material, said second auger housing being parallel to said first auger housing, and said second auger housing including a plurality of discharge openings spaced apart along the length of said second auger housing, said openings being positioned above respective ones of said hoppers and for depositing solid waste material into said hoppers, said means for conveying solid waste material from the refuse material supply container including a pair of supply conveyors positioned in side-by-side parallel relation, each of said supply conveyors including one end positioned adjacent the refuse material supply container and an opposite end positioned above said auger housings and for depositing solid waste material into said auger housings, and said means for returning refuse material to said refuse material supply further including a second return conveyor positioned adjacent and in side-by-side relation to said return conveyor, and wherein said return conveyors each include opposite ends, one of said opposite ends of each of said return conveyors being positioned beneath said opposite ends of said auger housings for receiving material from said opposite ends of said auger housings, and said return conveyors including opposite ends adjacent said refuse material supply for returning refuse material to said refuse material supply.

14. Apparatus for supplying solid waste material from a refuse material supply to a boiler for use as fuel in the boiler, the apparatus comprising:

a plurality of chargers for supplying solid waste material to the boiler, said chargers being positioned in side-by-side relation, each of said chargers including a solid waste material container housing a quantity of solid waste material, said solid waste material containers each including an opening, an auger housing mounted above said chargers, said auger housing including a bottom having a plurality of openings communicating with said solid waste material containers of said chargers whereby solid material can fall through said openings into said solid waste material containers, an auger mounted in said auger housing and supported therein for rotation around a central longitudinal axis so as to carry refuse material from one end of said auger housing toward an opposite end of said auger housing, means for conveying solid waste material from the refuse material supply to said one end of said auger housing and including means for depositing refuse into said one end of said auger housing, means for returning refuse material to said refuse material supply, said means for returning including a return conveyor mounted adjacent said opposite end of said auger housing and adapted to receive material from said opposite end of said auger housing, a second auger housing mounted above said solid waste material supply containers, said second auger housing including opposite ends one of said ends being adapted to receive refuse material from said means for conveying and an opposite end adapted to deliver solid waste to said means for returning refuse material, said second auger housing being parallel to said first auger housing, and said second auger housing including a plurality of discharge openings spaced apart along the length of said second auger housing, said openings being positioned above respective ones of said solid waste material supply containers and for depositing solid waste material into said solid waste material supply containers, said means for conveying solid waste material from the refuse material supply including a pair of supply conveyors positioned in side-by-side parallel relation, each of said supply conveyors including one end positioned adjacent the refuse material supply container and an opposite end positioned above said auger housings and for depositing solid waste material into said auger housings, and said means for returning refuse material to said refuse material supply further including a second return conveyor positioned adjacent and in side-by-side relation to said return conveyor, and wherein said return conveyors each include opposite ends, one of said opposite ends of each of said return conveyors being positioned beneath said opposite ends of said auger housings for receiving material from said auger housings and said return conveyor opposite ends being adjacent said refuse material supply for returning refuse material to said refuse material supply.

15. Apparatus for supplying comminuted combustible solid waste material from a refuse material supply to a combustion apparatus for use as fuel and wherein the combustion apparatus includes a plurality of fuel charging means positioned in side-by-side relation, each of said fuel charging means including a hopper for receiving comminuted combustible solid waste material, the apparatus comprising an auger housing mounted above the hoppers of the fuel charging means, the auger housing including an inner surface and opposite ends and a bottom having a plurality of discharge openings spaced apart along the length of said auger housing, said openings being positioned above respective ones of the hoppers whereby solid waste material can fall from the auger housing into the hoppers, an auger mounted in said auger housing and supported therein for rotation around a central longitudinal axis so as to carry refuse material from one end of said auger housing toward an opposite end of said auger housing, said auger including a central auger tube and an auger flight surrounding said auger tube and fixed to said auger tube, said auger tube having a diameter of at least approximately 18 inches, said auger having a diameter of at least approximately 4 feet, and a periphery spaced from said inner surface of said auger housing by at least approximately 2 inches, means for conveying solid waste material from the refuse material supply to said one end of said auger housing and including means for depositing refuse into said one end of said auger housing, said means for conveying solid waste material including a supply conveyor, said supply conveyor including opposite ends, one of said opposite ends of said supply conveyor being adjacent said refuse material supply and an opposite end being positioned above said one end of said auger housing, said means for supplying being adapted to supply refuse material to said auger housing at a rate greater than the rate the refuse material is supplied from the fuel charging means to the combustion apparatus, and means for returning refuse material to said refuse material supply, said means for returning including a return conveyor mounted adjacent said opposite end of said auger housing and adapted to receive material from said opposite end of said auger housing, said return conveyor including opposite ends, one of said return conveyor opposite ends being positioned beneath the other of said opposite ends of said auger housing and being adapted to receive solid waste material from said auger housing, and the other of said return conveyor opposite ends returning refuse material to the refuse material supply.

16. Apparatus as set forth in claim 15 and further including a second auger housing mounted above said hoppers, said second auger housing being parallel to said first auger housing, and said second auger housing including a plurality of discharge openings spaced apart along the length of said second auger housing, said openings being positioned above respective ones of said hoppers and for depositing solid waste material into said hoppers.

17. Apparatus as set forth in claim 16 wherein said means for conveying solid waste material from the refuse material supply container includes a pair of supply conveyors positioned in side-by-side parallel relation, each of said supply conveyors including one end positioned adjacent the refuse material supply container and an opposite end positioned above said auger housings and for depositing solid waste material into said auger housings.

18. Apparatus as set forth in claim 17 wherein said means for returning refuse material to said refuse material supply further includes a second return conveyor positioned adjacent and in side-by-side relation to said return conveyor, and wherein said return conveyors each include opposite ends, one of said opposite ends of each of said return conveyors being positioned beneath the other of said opposite ends of said auger housings for receiving material from said auger housings and said return conveyors including opposite ends adjacent said refuse material supply for returning refuse material to said refuse material supply.

19. Apparatus for supplying solid waste material from a refuse material supply to a combustion apparatus for use as fuel, the apparatus comprising an auger housing including an inner surface and a bottom having an opening whereby solid material can fall from the auger housing to be conveyed to the combustion apparatus, an auger mounted in said auger housing and supported therein for rotation around a central longitudinal axis so as to carry refuse material from one end of said auger housing toward an opposite end of said auger housing, said auger including a central auger tube and an auger flight surrounding said auger tube and fixed to said auger tube, said auger tube having a diameter of at least approximately 18 inches, said auger have a diameter of at least approximately 4 feet, and said auger including a periphery spaced from said inner surface of said auger housing by at least approximately 2 inches, means for conveying solid waste material from the refuse material supply to said one end of said auger housing and including means for depositing refuse into said one end of said auger housing, and means for returning refuse material to said refuse material supply, said means for returning including a return conveyor mounted adjacent said opposite end of said auger housing and adapted to receive material from said opposite end of said auger housing, said means for conveying solid waste material including a supply conveyor, said supply conveyor including opposite ends, one of said opposite ends being adjacent said refuse material supply and an opposite end being positioned above said one end of said auger housing, and wherein said return conveyor includes opposite ends, one of said opposite ends of said return conveyor being positioned beneath the other of said opposite ends of said auger housing and adapted to receive solid waste material from said auger housing, and the other of said return conveyor opposite ends returning refuse material to the refuse material supply.

20. Apparatus for supplying comminuted combustible solid waste material from a refuse material supply to a combustion apparatus for use as fuel and wherein the combustion apparatus includes at least two fuel charging means each having a container means for receiving comminuted combustible solid waste material, and the container means being positioned in side-by-side relation, the apparatus comprising:

an auger housing mounted above the container means of the fuel charging means, the auger housing including an inner surface and a bottom having at least two openings, one of the openings positioned above one of the container means and the other opening positioned above the other of the container means whereby solid material can fall from the auger housing through the openings into the container means;

an auger mounted in said auger housing and supported therein for rotation around a central longitudinal axis so as to carry refuse material from a first portion of said auger housing toward a second portion of said auger housing, said auger including a central auger tube and an auger flight surrounding said auger tube and fixed to said auger tube, said auger tube having a diameter of at least approximately 18 inches, said auger having a diameter of at least approximately 4 feet, and said auger including a periphery spaced from said inner surface of said auger housing by at least approximately 2 inches;

means for conveying solid waste material from the refuse material supply to said first portion of said auger housing and including means for depositing refuse into said first portion of said auger housing; and a return conveyor mounted adjacent said second portion of said auger housing and adapted to receive material from said second portion of said auger housing.

21. An auger assembly for use with apparatus for supplying solid waste material to an apparatus for burning the solid waste material and wherein the apparatus for supplying solid waste material to the apparatus for burning the solid waste material includes a plurality of chargers each having a solid waste storage container, the chargers being positioned in side-by-side relation, the auger assembly comprising:

an auger housing mounted above the solid waste storage containers, the auger housing having an inner surface and including a bottom having a plurality of openings communicating with the solid waste storage containers whereby solid material can fall into the solid waste storage containers; and an auger mounted in said auger housing and supported therein for rotation around a central longitudinal axis so as to carry refuse material from a first portion of said auger housing toward a second portion of said auger housing, said auger including a central auger tube and an auger flight surrounding said auger tube and fixed to said auger tube, said auger tube having a diameter of at least approximately 18 inches and said auger having a diameter of at least approximately 4 feet, and said auger including a periphery spaced from said inner surface of said auger housing by at least approximately 2 inches.

* * * * *

UNITED STATES PATENT AND TRADEMARK OFFICE

CERTIFICATE OF CORRECTION

PATENT NO. : 4,686,913

DATED : August 18, 1987

INVENTOR(S) : Donald J. Kaminski et al.

It is certified that error appears in the above-identified patent and that said Letters Patent is hereby corrected as shown below:

Column 8, Claim 11, line 59, "claim and" should be --claim 10 and--.

Signed and Sealed this

Twenty-ninth Day of December, 1987

*Attest:*

DONALD J. QUIGG

*Attesting Officer*

*Commissioner of Patents and Trademarks*